US012434929B2

(12) United States Patent
Nakajima et al.

(10) Patent No.: US 12,434,929 B2
(45) Date of Patent: Oct. 7, 2025

(54) SHEET CONVEYANCE APPARATUS AND IMAGE FORMING APPARATUS

(71) Applicant: CANON KABUSHIKI KAISHA, Tokyo (JP)

(72) Inventors: Keita Nakajima, Shizuoka (JP); Ko Katahira, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 294 days.

(21) Appl. No.: 18/362,711

(22) Filed: Jul. 31, 2023

(65) Prior Publication Data

US 2024/0051773 A1 Feb. 15, 2024

(30) Foreign Application Priority Data

Aug. 9, 2022 (JP) ..... 2022-126812

(51) Int. Cl.

| | |
|---|---|
| ***B65H 5/06*** | (2006.01) |
| ***B65H 3/06*** | (2006.01) |
| ***B65H 3/44*** | (2006.01) |
| ***B65H 29/14*** | (2006.01) |
| ***B65H 31/02*** | (2006.01) |

(52) U.S. Cl.

CPC ..... *B65H 5/062* (2013.01); *B65H 3/0669* (2013.01); *B65H 3/0684* (2013.01); *B65H 3/44* (2013.01); *B65H 29/14* (2013.01); *B65H 31/02* (2013.01); *B65H 2801/06* (2013.01)

(58) Field of Classification Search

CPC . B65H 5/062; B65H 3/0684; B65H 2404/144
See application file for complete search history.

(56) References Cited

U.S. PATENT DOCUMENTS

| | | | | |
|---|---|---|---|---|
| 9,715,210 | B2 * | 7/2017 | Miyoshi | G03G 21/1623 |
| 10,023,411 | B2 * | 7/2018 | Yamaguchi | G03G 15/6529 |
| 10,466,641 | B2 * | 11/2019 | Nosho | G03G 15/757 |
| 10,526,148 | B2 * | 1/2020 | Kuriki | B65H 3/5284 |
| 2004/0178571 | A1 * | 9/2004 | Ohama | B65H 29/14 271/272 |
| 2011/0115148 | A1 * | 5/2011 | Nakaishi | B65H 29/125 271/272 |

FOREIGN PATENT DOCUMENTS

| | | | | |
|---|---|---|---|---|
| JP | 2014105104 A | * | 6/2014 | H04N 1/00588 |
| JP | 2019137517 A | | 8/2019 | |

* cited by examiner

*Primary Examiner* — Howard J Sanders
(74) *Attorney, Agent, or Firm* — Canon U.S.A., Inc. IP Division

(57) ABSTRACT

A sheet conveyance apparatus includes a roller pair having first and second rollers, a roller holder having first and second guided portions, and a guiding portion having first and second guides. The first and second rollers can take a first state where the first roller contacts the second roller with a predetermined force and take a second state where the predetermined force is reduced. A first direction in which the first guide guides the first guided portion is inclined relative to a second direction in which the second guide guides the second guided portion. When viewed in a rotational axis direction of the first roller with the first and second rollers in the first state, an angle formed by a straight line passing through rotational centers of the first and second rollers and the first direction is smaller than an angle formed by the straight line and the second direction.

18 Claims, 17 Drawing Sheets

N
23b'
24'
25'
R
T
λ
25c'

H
N
HD
23b'
F
24'
25'
25b'
30'
25a'
31'
29'
S
60'

N2
N1
θ
23b'
24'
25'
25b'
25a'
29'

SHEET CONVEYANCE APPARATUS AND IMAGE FORMING APPARATUS

BACKGROUND

Field

The present disclosure relates to a sheet conveyance apparatus, and more particularly, to a sheet conveyance apparatus for conveying sheets such as recording sheets and document sheets, mounted on image forming apparatuses such as printers, facsimiles, and copying machines.

Description of the Related Art

A certain sheet conveyance apparatus is configured to bias one roller to the other roller to bring the rollers into contact with each other. In a known example of this configuration, the one roller is a drive roller rotating by a driving force of a drive source, and the other roller is a driven roller driven to rotate by the drive roller. Japanese Patent Application Laid-Open No. 2019-137517 discusses a configuration in which a driven roller holder for slidably and rotatably holding a driven roller is pressed by a spring, and the driven roller comes into contact with a drive roller.

SUMMARY

The present disclosure is directed to providing a sheet conveyance apparatus effectively using the space around rollers while restricting a large change of the sheet conveyance direction.

According to an aspect of the present disclosure, a sheet conveyance apparatus includes a roller pair configured to convey a sheet and including a first roller and a second roller, a biasing member, a roller holder configured to hold the first roller and to be biased by the biasing member so that the first roller is biased toward the second roller, wherein the roller holder includes a guided portion and the guided portion includes a first guided portion and a second guided portion positioned upstream of the first guided portion in a biasing direction of the biasing member, and a guiding portion including a first guide and a second guide, wherein the first guide is configured to movably support and guide the first guided portion, the second guide is configured to movably support and guide the second guided portion, and the guiding portion is configured to movably guide the roller holder so that the first and second rollers can take a first state where the first roller comes into contact with the second roller with a contact force that is a predetermined force and take a second state where the contact force is reduced from the predetermined force, wherein a first direction in which the first guide guides the first guided portion is inclined relative to a second direction in which the second guide guides the second guided portion, and wherein, when viewed in a rotational axis direction of the first roller in a case where the first and second rollers are in the first state, an angle formed by a straight line passing through rotational centers of the first and second rollers and the first direction is smaller than an angle formed by the straight line and the second direction.

Further features of the present disclosure will become apparent from the following description of exemplary embodiments with reference to the attached drawings.

DESCRIPTION OF THE EMBODIMENTS

Figures 17A, 17B, 17C:
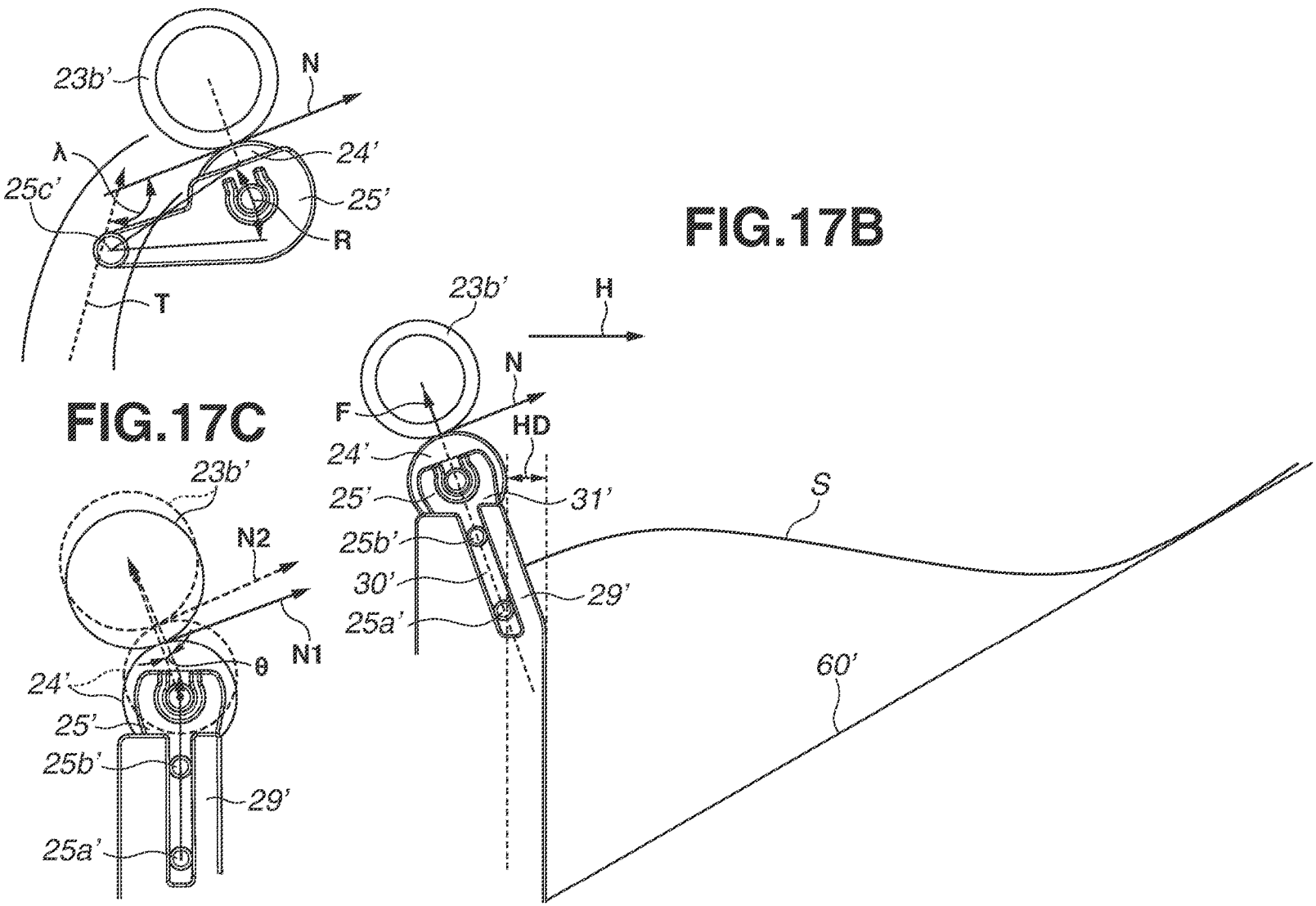
FIGS. 17A to 17C illustrate a conveyance roller pair of an image forming apparatus according to the comparative example.

FIGS. 17A to 17C illustrate a conveyance roller pair of an image forming apparatus according to a comparative example. The conveyance roller pair includes a conveyance roller rotating by a driving force, and a driven roller driven to rotate by the conveyance roller.

In the configuration illustrated in FIG. 17A, a driven roller 24' is slidably and rotatably held by a roller holder 31', and the roller holder 31' rotatable around a rotational center 25*c*' is pressed toward a conveyance roller 23*b*' by a spring (not illustrated). As a result, a nip of the conveyance roller pair (conveyance rollers 23*b*' and 24') is formed. However, when the intersecting angle λ between the conveyance direction T of the conveyance path for conveying a sheet to the nip of the conveyance roller pair (conveyance rollers 23*b*' and 24') and the conveyance direction N of the conveyance roller pair is an obtuse angle, the position of the rotational center 25*c*' overlaps with the conveyance path, and hence the rotational center 25*c*' may not be disposed.

The conveyance roller pair (conveyance rollers 23*b*' and 24') illustrated in FIG. 17B discharges a sheet S onto a sheet discharge tray 60' for stacking sheets S. The driven roller 24' is rotatably held by the roller holder 31'.

The roller holder 31' is provided with two pairs of bosses 25*a*' and 25*b*' in the direction perpendicular to the nip line. While sliding with a groove 30' as a part of a frame 29', the roller holder 31' pressed by a spring (not illustrated) linearly moves in the direction of a nip pressure F. The groove 30' is disposed so that the upstream boss 25*a*' and the downstream boss 25*b*' of the roller holder 31' are disposed on the line connecting the centers of the conveyance roller 23*b*' and the driven roller 24'.

The conveyance direction N of the conveyance roller pair (conveyance rollers 23*b*' and 24') has an angle relative to the horizontal direction H and conveys the sheet S in the obliquely upward direction. However, in this configuration, allocating a space for disposing the spring, the roller holder 31', and the frame 29' will increase the distance HD from the outer diameter edge of the driven roller 24' of the frame 29' for holding the roller holder 31' in the horizontal direction H. The longer the distance HD, the higher the possibility that the trailing edge of the discharged sheet S is caught on the frame 29'.

In the configuration illustrated in FIG. 17C, the conveyance direction of the conveyance roller pair (conveyance rollers 23*b*' and 24') is an obliquely upward direction, and the driven roller holder 24' is linearly moved in the vertical direction. In the configuration where the linear movement direction of the driven roller holder 24' is different from the nip pressure direction of the conveyance roller pair (conveyance rollers 23*b*' and 24'), if the conveyance roller 23*b*' is bent by the nip pressure and shifts from the solid-line position to the dotted-line position, the driven roller 24' moves from the solid-line position to the dotted-line position.

As a result, the driven roller 24' relatively rotates counterclockwise around the conveyance roller 23*b*'. Therefore, the angle of the conveyance direction changes by the angle θ formed by the line connecting with the center of the conveyance roller pair (conveyance rollers 23*b*' and 24') drawn with a solid line, and the line connecting with the center of the conveyance roller pair (conveyance rollers 23*b*' and 24') drawn with a dotted line. Then, the conveyance direction changes from N1 to N2. Particularly if the outer diameter of the conveyance roller 23*b*' is small, the conveyance direction largely changes, possibly preventing the sheets S from being normally stacked on the sheet discharge tray.

As an example of a configuration of the image forming apparatus according to a first exemplary embodiment, an electrophotographic laser printer will be described below. The following describes an overall configuration of the image forming apparatus according to the present exemplary embodiment, and then describes a configuration of a sheet discharge unit of the image forming apparatus according to the present exemplary embodiment.

Figure 1:
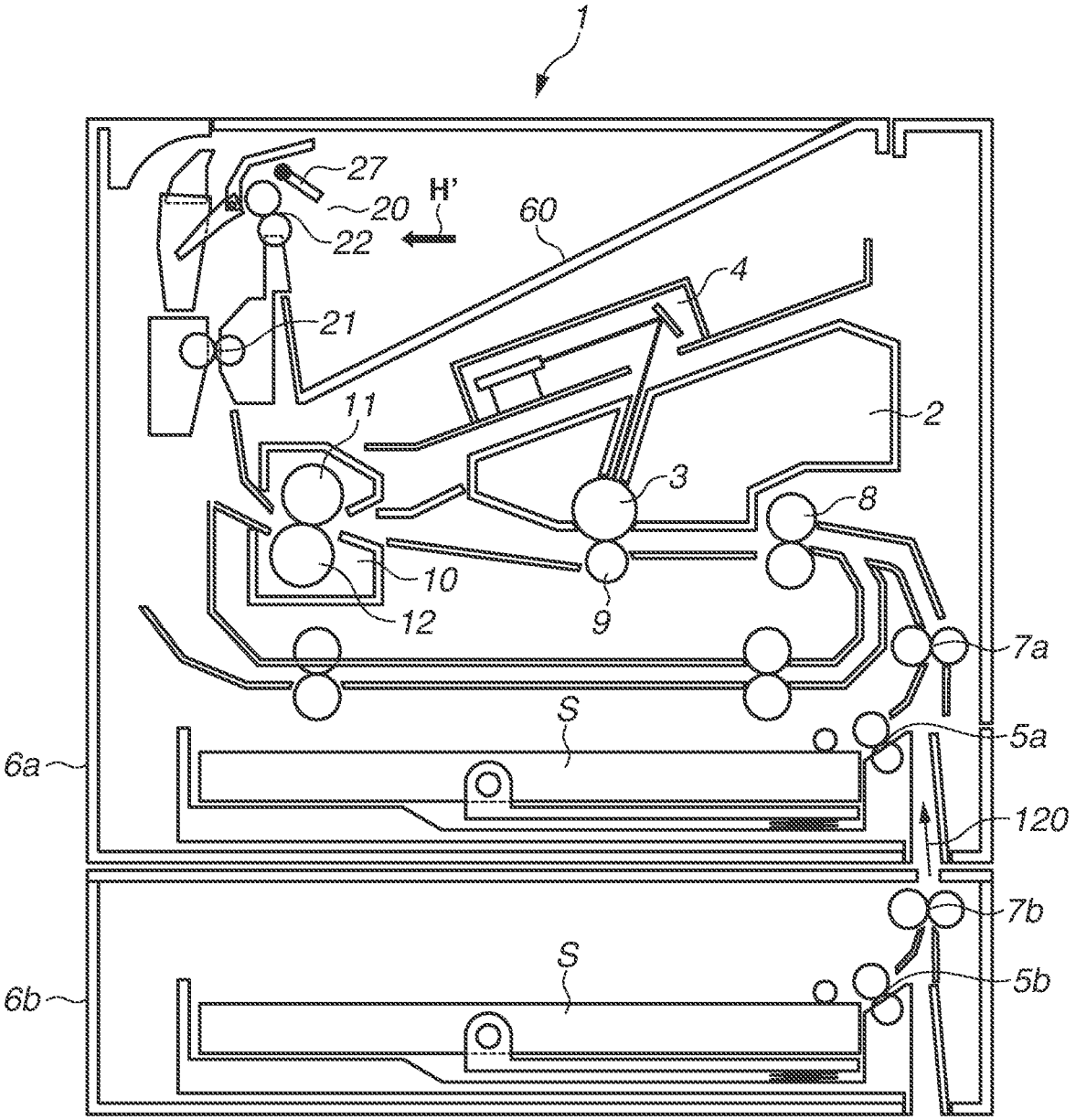
FIG. 1 is a cross-sectional view illustrating an image forming apparatus.

FIG. 1 is a cross-sectional view illustrating a configuration of an electrophotographic laser printer having a double-sided image forming function as an example of an image forming apparatus. Sizes, materials, shapes, and relative arrangements of components described in the following exemplary embodiments are not limited thereto. Unless otherwise specifically described, the scope of the present disclosure is not limited to the exemplary embodiments. The image forming apparatus according to the present exemplary embodiment is not limited to a laser printer but is applicable to copying machines, facsimiles, and other image forming apparatuses.

An image forming apparatus 1 illustrated in FIG. 1 roughly includes a sheet feeding unit, an image forming unit (a photosensitive drum 3 and a transfer roller 9) for forming an image on a sheet, a fixing unit (fixing apparatus 10), and a sheet discharge unit 20.

The image forming apparatus 1 includes a process cartridge 2 attachable to and detachable from the apparatus main body. The process cartridge 2 includes a process unit including a photosensitive drum 3, a developing unit (not illustrated), a charge roller (not illustrated), and the like. A scanner unit 4 disposed vertically above the process cartridge 2 emits light based on an image signal to the photosensitive drum 3 for exposure.

After the photosensitive drum 3 has been charged to a predetermined negative polarity potential by the charge roller (not illustrated), an electrostatic latent image is formed on the drum 3 by the scanner unit 4. The electrostatic latent image is applied with negative-polarity toner by the developing unit (not illustrated) in the process cartridge 2 for reversal development, and a toner image is formed.

The sheet feeding unit includes a sheet feeding unit 5*a* attached to the image forming apparatus 1, and a sheet feeding cassette 6*a* for storing sheets S attachable to and detachable from the image forming apparatus 1. The sheets S stored in the sheet feeding cassette 6*a* are separated and fed one by one from the sheet feeding cassette 6*a* by the sheet feeding unit 5*a* that is rotated by the power of a sheet feeding drive unit (not illustrated). A fed sheet S is conveyed to a registration roller pair 8 by a conveyance roller pair 7*a*, and subjected to skew correction and conveyed to a transfer unit by the registration roller pair 8.

A sheet feeding cassette 6*b* also stores sheets S with a different size from or the same size as the sheets S in the sheet feeding cassette 6*a*.

The transfer unit is configured to apply a positive-polarity bias to the transfer roller 9 by a bias application unit (not illustrated). Thus, a toner image is transferred as a non-fixed image onto the sheet S conveyed to the transfer unit.

The sheet S with the toner image transferred thereon is conveyed to the fixing apparatus 10 provided downstream of the transfer unit in the conveyance direction. The fixing apparatus 10 for fixing the toner image transferred on the sheet S includes a heat roller 11 as a fixing member heated by a heater as heating unit (not illustrated), and a pressure roller 12 as a pressurizing member rotating in pressure contact with the heat roller 11. The sheet S is conveyed while being pinched by a fixing nip portion formed by the heated roller 11 and the pressure roller 12. When the toner image is heated and pressurized, the toner image is fixed onto the surface of the sheet S.

Figure 3A:
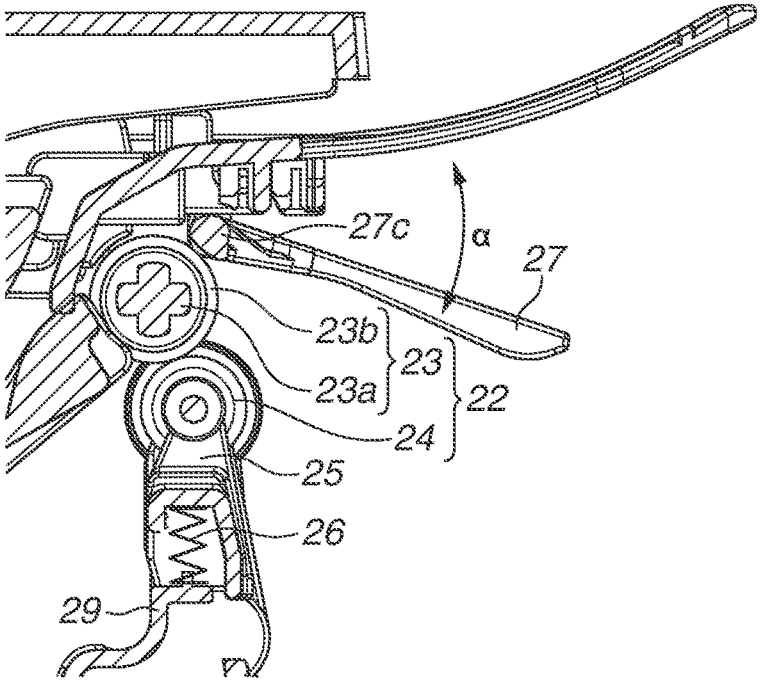
FIGS. 3A and 3B are cross-sectional views illustrating another periphery of the sheet discharge roller pair according to the first exemplary embodiment.

Then, the sheet S with the toner image fixed thereto is discharged from the fixing apparatus 10 onto a sheet discharge tray 60 for stacking sheets S discharged by a sheet discharge roller pair 22 (described below) illustrated in FIGS. 3A and 3B.

The sheet discharge unit 20 that characterizes the present exemplary embodiment will be described below with reference to FIGS. 2 to 10.

Figure 2:
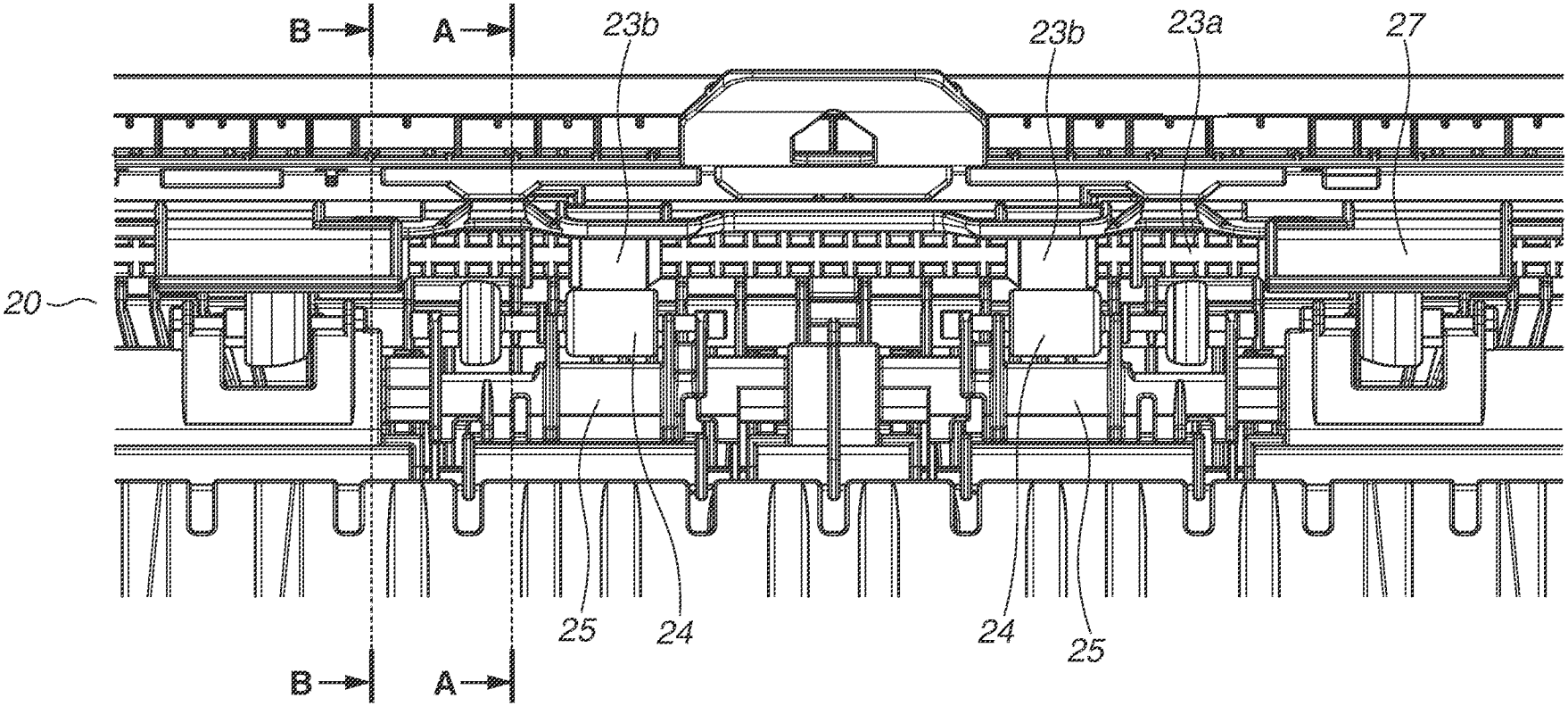
FIG. 2 illustrates a periphery of a sheet discharge roller pair according to a first exemplary embodiment.

FIG. 2 illustrates a periphery of the sheet discharge roller pair 22 when viewed from the direction of the arrow H' in FIG. 1. FIGS. 3A and 3B are cross-sectional views illustrating another periphery of the sheet discharge roller pair 22. More specifically, FIG. 3A is a partial cross-sectional view taken along the A-A line in FIG. 2, and FIG. 3B is a partial cross-sectional view taken along the B-B line in FIG. 2.

The sheet discharge roller pair 22 includes a sheet discharge roller 23 as a second roller rotatably driven by a driving source (not illustrated). The sheet discharge roller pair 22 further includes a sheet discharge driven roller 24 as a first roller driven to rotate by the rotation of the sheet discharge roller 23. The sheet discharge driven roller 24, when pressed by a pressing spring 26, comes into contact with the sheet discharge roller 23 to form a nip. As a result, the sheet S is conveyed while being pinched by the sheet discharge roller 23 and the sheet discharge driven roller 24. The sheet discharge driven roller 24 is positioned vertically below the sheet discharge roller 23.

The sheet discharge roller 23 includes a sheet discharge roller axis 23*a*, and two rubber rollers 23*b* along the direction of the sheet discharge roller axis 23*a*, and brings the sheet discharge driven roller 24 into contact with each of the rubber rollers 23*b*. The sheet discharge driven roller 24 is rotatably held to the roller holder 31. The roller holder 31 is provided with a projection 25 that engages with a groove 30 (described below) to be movably regulated. The roller holder 31 is attachable to and detachable from the apparatus main body together with the sheet discharge driven roller 24. The roller holder 31 has two different projections 25 (guided portions, to be guided portions): a first projection 25*b* (first guided portion), and a second projection 25*a* (second guided portion) positioned upstream of the first projection 25*b* in the biasing direction of a biasing member (the pressing spring 26 to be described below).

A sheet discharge frame 29 (guiding portion) is a part of the frame of the main body of the image forming apparatus 1. The sheet discharge frame 29 is provided with the groove 30 as an opening for storing the projections 25. The groove 30 includes a first groove 30*b* (first guide) for movably supporting and guiding the first projection 25*b*, and a second groove 30*a* (second guide) for movably supporting and guiding the second projection 25*a*. In other words, the first projection 25*b* and the second projection 25*a* are stored in the groove 30, and the first projection 25*b* and the second projection 25*a* are movably guided by a portion (plane) forming the first groove 30*b* and the second groove 30*a*, respectively.

Thus, the sheet discharge frame 29 allows the roller holder 31 to be movable so that the sheet discharge roller 23 and the sheet discharge driven roller 24 come into pressure contact with each other (pressure contact state or first state) and come out of pressure contact (released state or second state).

According to the present exemplary embodiment, in a state where the sheet discharge roller 23 and the sheet discharge driven roller 24 are in pressure contact with each other, the sheet S can be conveyed. In a state where the sheet discharge roller 23 and the sheet discharge driven roller 24 are out of pressure contact, the rollers 23 and 24 are separable. Although, according to the present exemplary embodiment, both rollers are configured to be separable in a state where the rollers 23 and 24 are out of pressure contact, the present exemplary embodiment is not limited thereto. The pressure contact force between the rollers may be reduced to an extent that sheet S jam recovery is possible, i.e., a light contact state.

The groove 30 further includes an intermediate groove 30*c* for connecting the first groove 30*b* and the second groove 30*a*. When the roller holder 31 is attached to the sheet discharge frame 29, the second projection 25*a* passes through the intermediate groove 30*c*. More specifically, the first groove 30*b* and the second groove 30*a* are provided at the portion where an opening is formed. Although, according to the present exemplary embodiment, a groove is provided as an opening on the sheet discharge frame 29, the opening may have any desired shape, for example an oblong hole, as long as the opening guides the projections.

The first groove 30*b* is inclined relative to the second groove 30*a*. More specifically, the direction (first direction) in which the first groove 30*b* guides the first projection 25*b*, i.e., the direction in which the first projection 25*b* moves in the first groove 30*b* is inclined relative to the direction (second direction) in which the second groove 30*a* guides the second projection 25*a*, i.e., the direction in which the second projection 25*a* moves in the second groove 30*a*.

In a relation where the first groove 30*b* is inclined relative to the second groove 30*a*, the angle formed by the first direction relative to the direction of the straight line passing through the rotational centers of the sheet discharge driven roller 24 and the sheet discharge roller 23 when viewed in the rotational axis direction of the sheet discharge driven roller 24 in a state where the sheet discharge driven roller 24 and the sheet discharge roller 23 are in pressure contact with each other is smaller than the angle formed by the second direction relative to the direction of the straight line.

Since the first groove 30*b* and the second groove 30*a* are not parallel to each other, the roller holder 31 and the sheet discharge driven roller 24 move along the groove 30, while rotating, relative to the apparatus main body. The moving locus of the sheet discharge driven roller 24 in this operation is different from the biasing direction and the directions of the first groove 30*b* and the second groove 30*a*. According to the present exemplary embodiment, the first groove 30*b* and the second groove 30*a* are formed so that the sheet discharge driven roller 24 moves toward the sheet discharge roller axis 23*a*.

More specifically, the angle formed by the lines A2 and A1 is smaller than the acute angle formed by the lines A1 and A3, where the line A1 is the line along the first direction, the line A2 is the line along the second direction, and the line A3 is the straight line passing through the rotational centers of the sheet discharge driven roller 24 and the sheet discharge roller 23. This means that the line A2 forms an angle closer to the vertical direction than the line A3. When the roller holder 31 and the sheet discharge driven roller 24 move, while rotating, relative to the apparatus main body based on this relation between the lines A1, A2, and A3, the sheet discharge driven roller 24 moves toward the sheet discharge roller axis 23*a*.

A more specific configuration of the lines A1, A2, and A3 will be described below. According to the present exemplary embodiment, the line A2 extends in the vertical direction. In other words, the second groove 30*a* extends in the vertical direction. Referring to FIG. 3B, the line A1 is a result of rotating the line A2 counterclockwise by an angle of 10 degrees (angle x=10°).

Figure 3B:
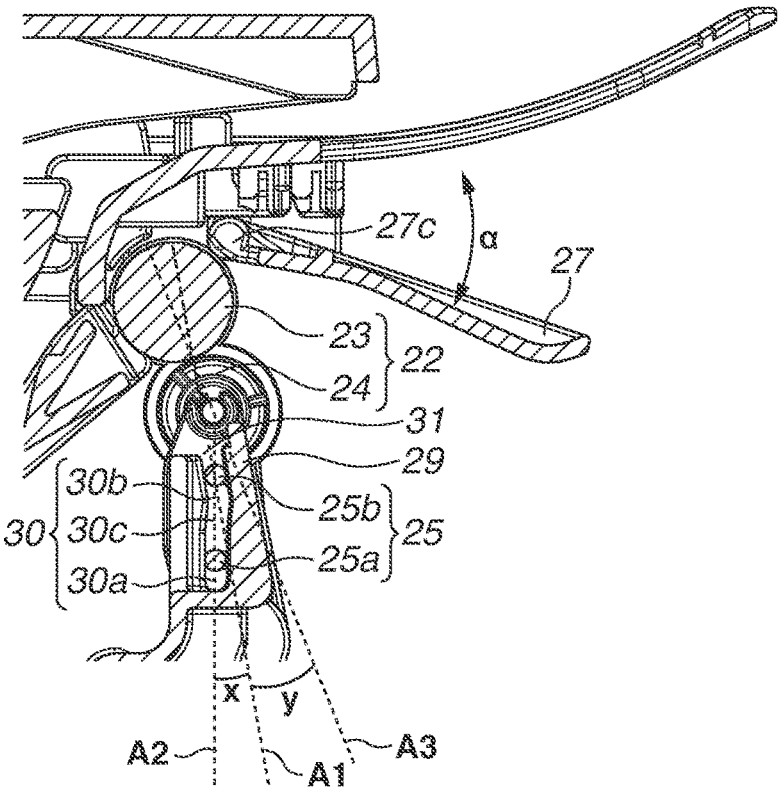

Referring to FIG. 3B, the line A3 is a result of rotating the line A1 counterclockwise by an angle of 10 degrees, i.e., the line A3 is a result of rotating the line A2 counterclockwise by an angle of 20 degrees (angle y=10°). The direct distance between the first projection 25*b* and the second projection 25*a* is 8 mm, and the direct distance between the first projection 25*b* and the rotational center of the sheet discharge driven roller 24 is 9 mm.

These angular configurations may be suitably changed according to the direction in which the sheet discharge driven roller 24 is to be biased. The angular ranges are represented by $0° < x < 90°$ and $0° \leq y < 90°$.

The pressing spring 26 (compression spring) as a biasing member is held at one end by the sheet discharge frame 29 and held at the other end by the roller holder 31. Thus, the pressing spring 26 presses the sheet discharge driven roller 24 toward the sheet discharge roller 23 to bring the sheet discharge driven roller 24 and the sheet discharge roller 23 into pressure contact with each other. The biasing direction of the pressing spring 26 is in the vertically upward direction, and the angle relative to the extending direction of the second groove 30*a* is smaller than the angle relative to the extending direction of the first groove 30*b*. Although the present exemplary embodiment uses a compression spring as a biasing member, any member for pressing the roller holder 31 is suitably applicable.

A sheet discharge full load detection flag 27 is provided to be rotatable around a rotational center 27*c*, as illustrated by the arrow a. The sheet S conveyed by the sheet discharge roller pair 22 presses the sheet discharge full load detection flag 27 and is conveyed to the sheet discharge tray 60.

Figure 4A:
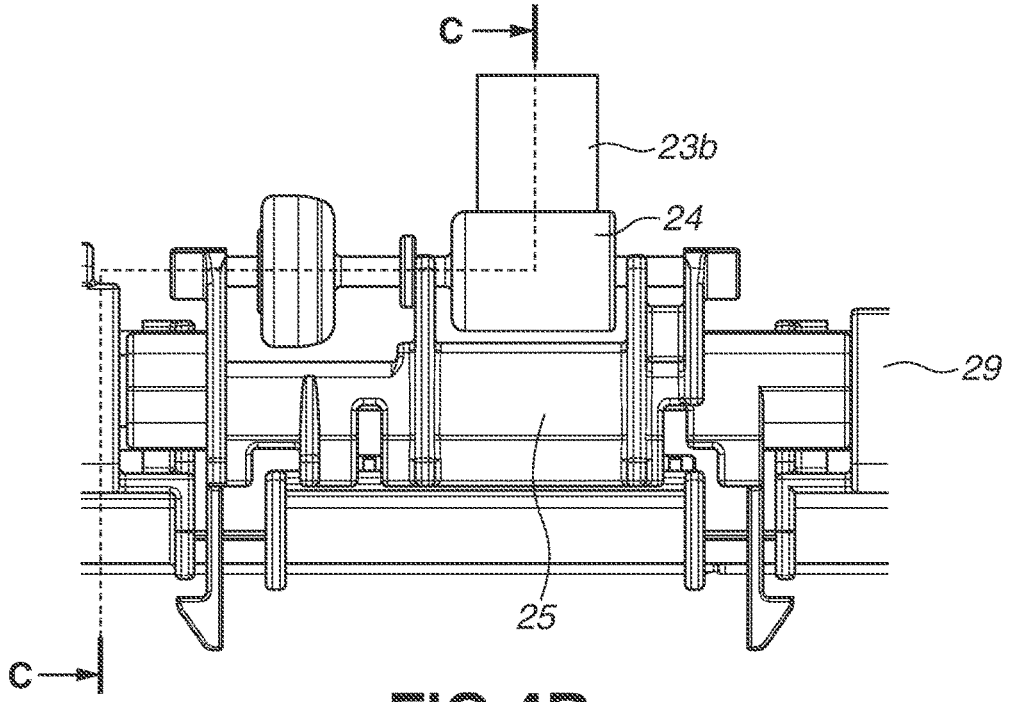
FIGS. 4A and 4B illustrate peripheries of a sheet discharge driven roller according to the first exemplary embodiment.
Figure 4B:
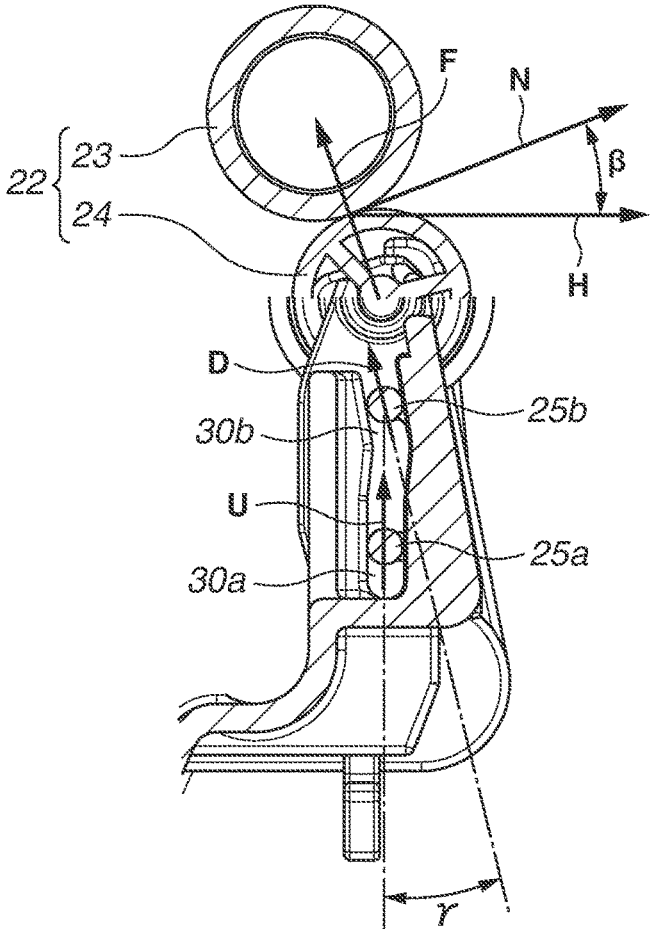
Figure 5:
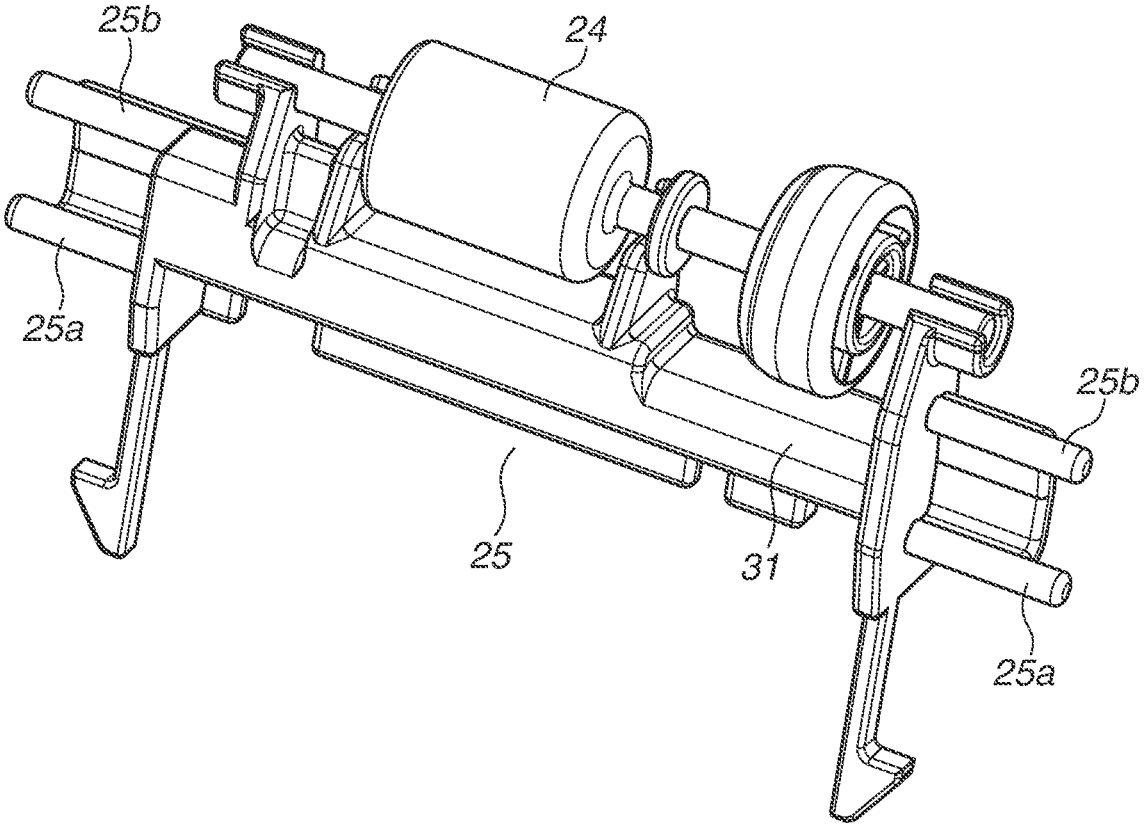
FIG. 5 is a perspective view illustrating a roller holder according to the first exemplary embodiment.

FIG. 4A is a cross-sectional view illustrating the image forming apparatus 1 when viewed in the direction of the arrow H' illustrated in FIG. 1. FIG. 4A illustrates only the sheet discharge frame 29, the rubber roller 23*b* as a part of the sheet discharge roller 23, the sheet discharge driven roller 24, and the roller holder 31. FIG. 4B is a cross-sectional view taken along the C-C line in FIG. 4A. FIG. 5 is a perspective view illustrating the roller holder 31.

As illustrated in FIG. 4B, the sheet discharge driven roller 24 is positioned at a position closer to the image forming unit than the sheet discharge roller 23 in the direction perpendicular to the axial directions of the sheet discharge roller 23 and the sheet discharge driven roller 24 and perpendicular to the vertical direction (the extending direction of the sheet discharge tray 60 when viewed from the vertical direction). More specifically, the sheet discharge driven roller 24 is positioned more on the front side of the image forming apparatus 1 than the sheet discharge roller 23. With this configuration, the conveyance direction of the sheet S by the sheet discharge roller pair 22 is an upward direction (arrow N) by an angle β from the horizontal direction H. Therefore, the discharged sheet S is not unlikely to disturb the aligned sheets on the sheet discharge tray 60.

As illustrated in FIG. 5, the roller holder 31 supports one discharge driven roller 24 according to the present exemplary embodiment. The two roller holders 31 are disposed in the rotational axis direction of the sheet discharge driven roller 24 to form two different nip portions.

Figure 6:
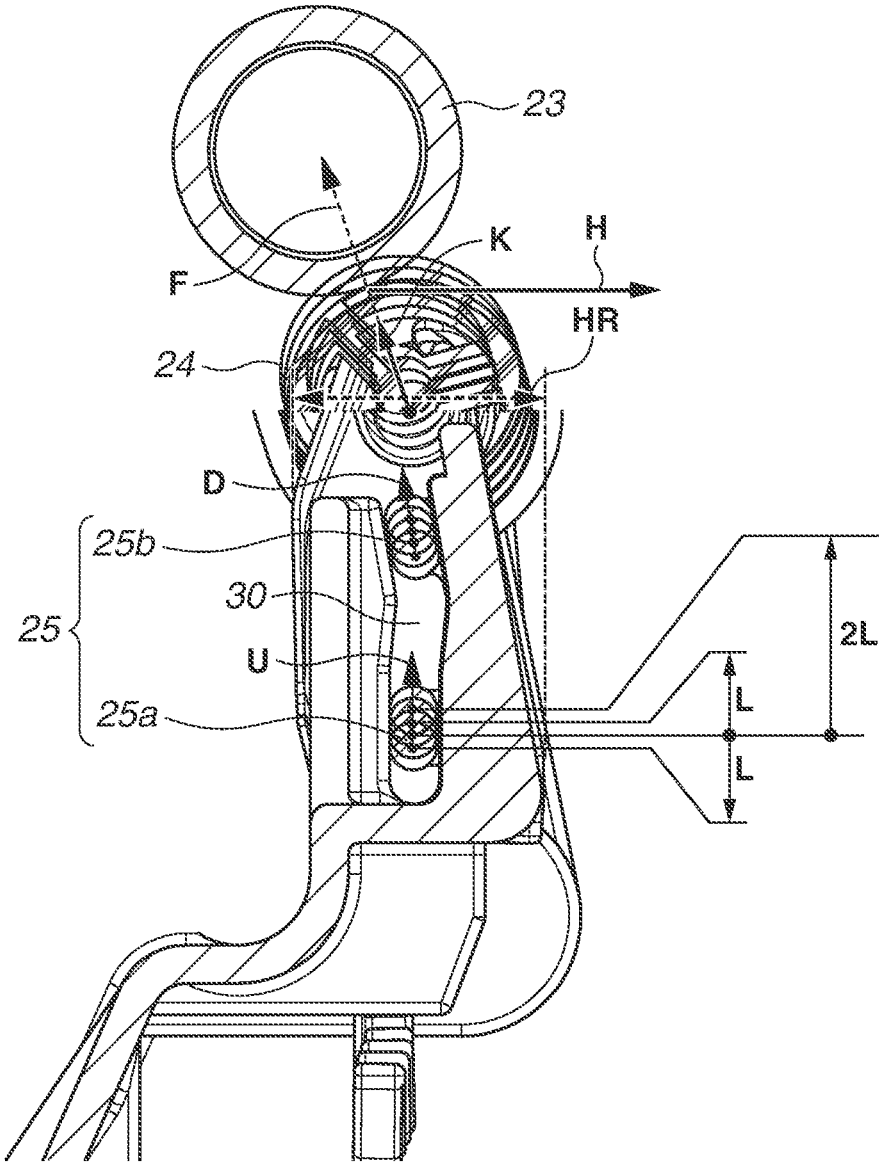
FIG. 6 is a cross-sectional view illustrating a locus of the sheet discharge roller pair according to the first exemplary embodiment.

FIG. 6 illustrates the loci of the sheet discharge driven roller 24 and the roller holder 31 in a state where the position of the sheet discharge roller 23 is fixed. FIG. 6 illustrates four different positions: the starting position where the sheet discharge roller 23 and the sheet discharge driven roller 24 are in contact with each other, the position as a result of the movement of an upstream boss 25*a* by a distance L below the starting position, the position as a result of the movement thereof by a distance L above the starting position, and the position as a result of the movement thereof by a distance 2L above the starting position.

The above-described configuration enables the moving direction K of the sheet discharge driven roller 24 and the nip pressure direction F to be approximately in parallel. As a result, even if the sheet discharge roller axis 23*a* is bent by the nip pressure, the angle of the conveyance direction N of the sheet S remains unchanged, thus achieving stable conveyance. This makes it possible to use a molding material having a low rigidity instead of a highly rigid metal as the sheet discharge roller axis 23*a*, achieving cost reduction.

Figure 7C:
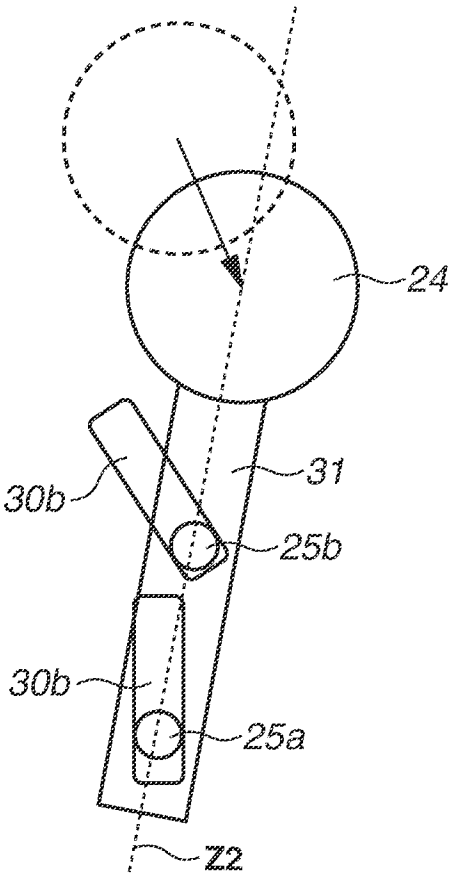
FIGS. 7A to 7C are cross-sectional views illustrating states where the sheet discharge driven roller and the roller holder are inclined according to the first exemplary embodiment.
Figure 7B:
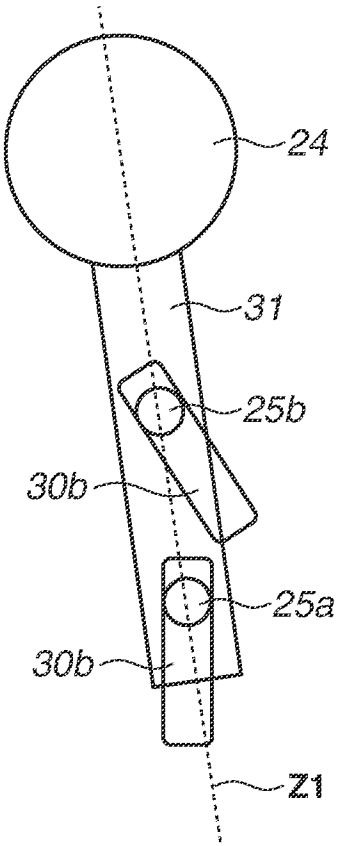
Figure 7A:
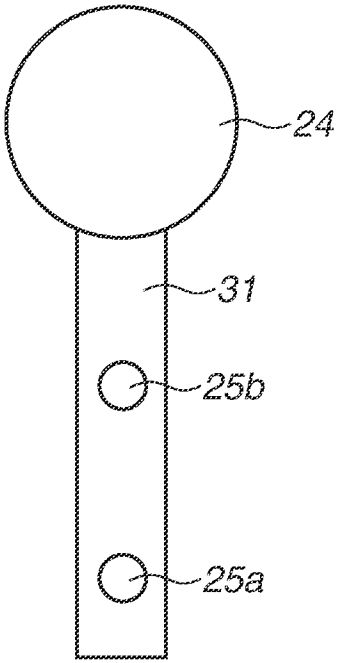

The inclination of the nip direction will be briefly described below with reference to FIGS. 7A to 7C and 8A to 8C. FIGS. 7A to 7C illustrate states where the sheet discharge driven roller 24 and the roller holder 31 are inclined when the projection 25 moves while being guided by the groove 30. FIG. 7A illustrates the sheet discharge driven roller 24 and the roller holder 31 in a simplified way, and FIGS. 7B and 7C illustrate states where the projection 25 is guided by the groove 30.

Figure 8A:
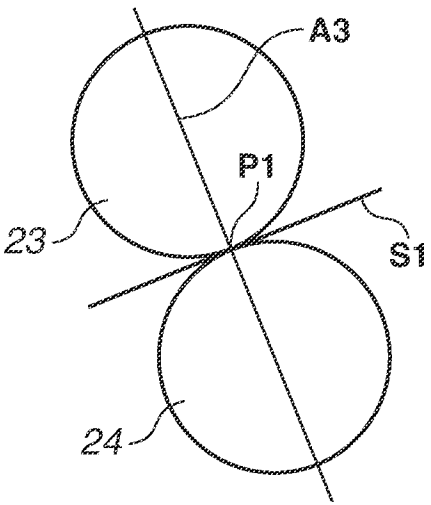
FIGS. 8A to 8C are cross-sectional views illustrating a sheet discharge roller and the sheet discharge driven roller according to the first exemplary embodiment.
Figure 8B:
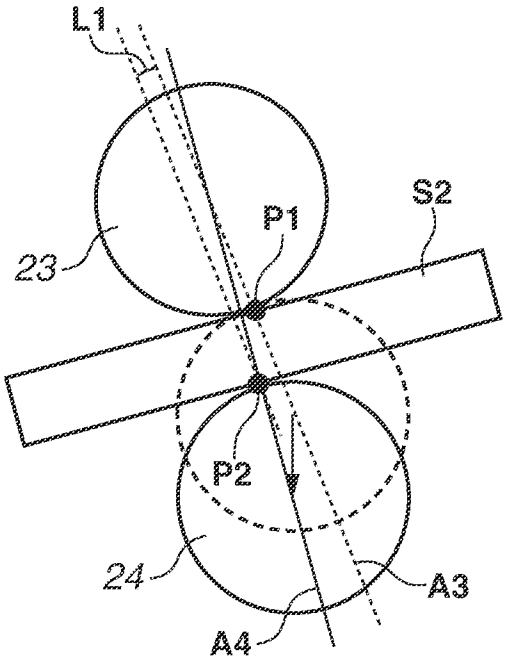
Figure 8C:
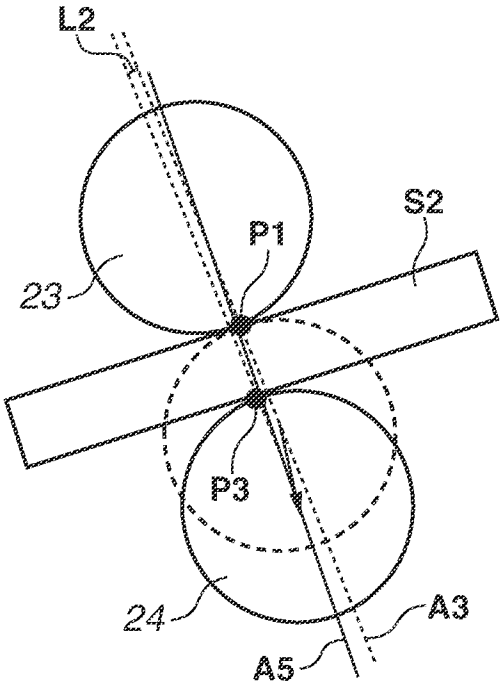

FIGS. 8A to 8C illustrate the sheet discharge roller 23 and the sheet discharge driven roller 24. FIG. 8A illustrates a state where a thin sheet S1 is pinched by the sheet discharge roller 23 and the sheet discharge driven roller 24. FIG. 8B illustrates a state where the sheet discharge roller 23 and the sheet discharge driven roller 24 pinch a thick sheet S2 when the sheet discharge driven roller 24 moves in the vertical direction as illustrated in FIG. 17C. FIG. 8C illustrates a state where the sheet discharge roller 23 and the sheet discharge driven roller 24 pinch the thick sheet S2 according to the present exemplary embodiment.

In a state where the sheet discharge driven roller 24 is in contact with the sheet discharge roller 23 as illustrated in FIG. 7B, when the thick sheet S2 passes through the nip portion formed by the sheet discharge roller 23 and the sheet discharge driven roller 24, and then the sheet discharge driven roller 24 is retracted, the sheet discharge driven roller 24 moves to the position illustrated in FIG. 7C. At this timing, a line Z1 passing through the first projection 25*b* and the second projection 25*a* in FIG. 7B is different in angle from a line Z2 passing through the first projection 25*b* and the second projection 25*a* in FIG. 7C. In this way, the sheet discharge driven roller 24 and the roller holder 31 moves, while rotating, relative to the apparatus main body.

Referring to FIGS. 8A to 8C, FIG. 8B illustrating a state where the sheet discharge driven roller 24 moves in the vertically downward direction is compared with FIG. 8C illustrating a state where the sheet discharge driven roller 24 moves in the lower right direction, with reference to FIG. 8A. Referring to FIG. 8A, the sheet discharge roller 23 and the sheet discharge driven roller 24 are in contact with each other at a contact point P1. Referring to FIG. 8B, the sheet S2 and the sheet discharge driven roller 24 are in contact with each other at a contact point P2. Referring to FIG. 8C, the sheet S2 and the sheet discharge driven roller 24 are in contact with each other at a contact point P3.

Referring to FIG. 8B, the straight line passing through the rotational centers of the sheet discharge roller 23 and the sheet discharge driven roller 24 is referred to as a line A4. Referring to FIG. 8C, the straight line passing through the rotational centers of the sheet discharge roller 23 and the sheet discharge driven roller 24 is referred to as a line A5.

Referring to FIG. 8B, the sheet discharge driven roller 24 moves in the vertically downward direction by the thick sheet S2. Thus, the line A4 inclines relative to the line A3. At this timing, the distance between the contact points P1 and P2 is L1 in the conveyance direction of the sheet S. Referring to FIG. 8C, the line A5 inclines relative to the line A3. Since the moving direction of the sheet discharge driven roller 24 is the lower right direction, the inclination between the lines A5 and A3 is smaller than the inclination between the lines A4 and A3. The distance between the contact points P1 and P3 is L2 in the conveyance direction of the sheet S.

Since the moving direction of the sheet discharge driven roller 24 is different from that in FIG. 8B, L2 is smaller than L1 (L1>L2). In the configuration of the present exemplary embodiment illustrated in FIG. 8C, the conveyance direction of the sheet S is more unlikely to change than that in the configuration illustrated in FIG. 8B because of the difference (L1>L2). This means that the present exemplary embodiment provides an excellent discharge performance.

In the above descriptions, the thick sheet S2 is used. The thicker the sheet S, the more markedly the effect of the present exemplary embodiment is exhibited. However, the effect that the conveyance direction of the sheet S is unlikely to change can be obtained even when the thin sheet S is used.

Figure 9:
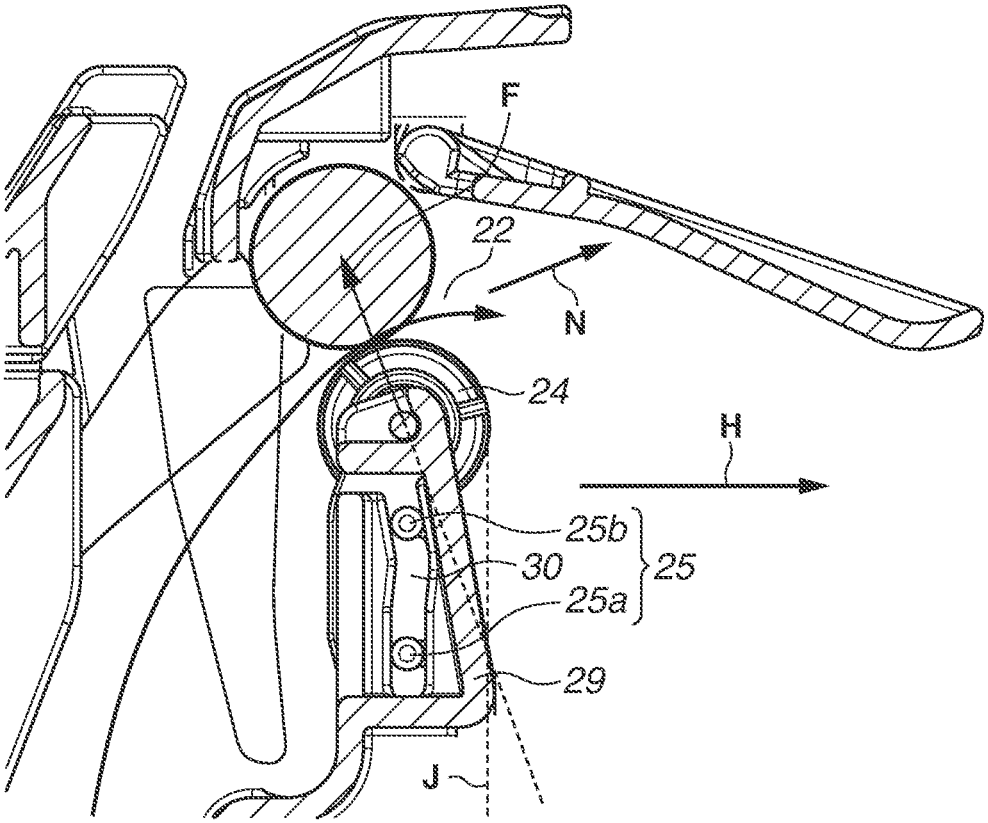
FIG. 9 is a cross-sectional view illustrating a sheet discharge direction according to the first exemplary embodiment.

As illustrated in FIG. 9, the groove 30 is disposed upstream of the line of the arrow F (the straight line passing through the rotational centers of the sheet discharge roller 23 and the sheet discharge driven roller 24) in the sheet S conveyance direction. Therefore, the protrusion amounts of the roller holder 31 and the sheet discharge frame 29 can be reduced. This enables reducing the possibility that the trailing edge of the discharged sheet S is caught on the sheet discharge frame 29.

Figure 10A:
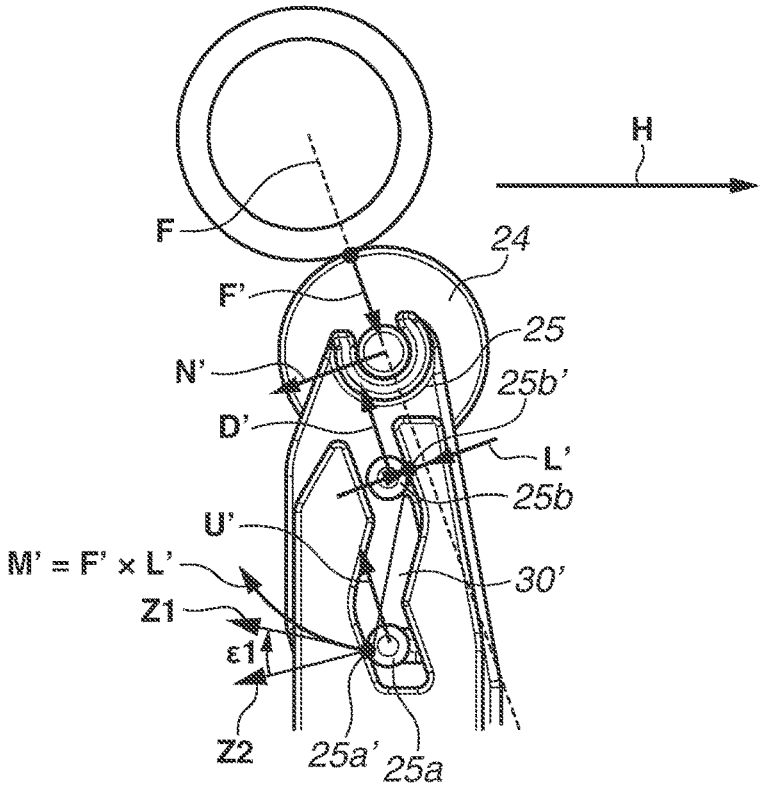
FIG. 10A illustrates a moving direction of a roller holder according to a comparative example.
Figure 10B:
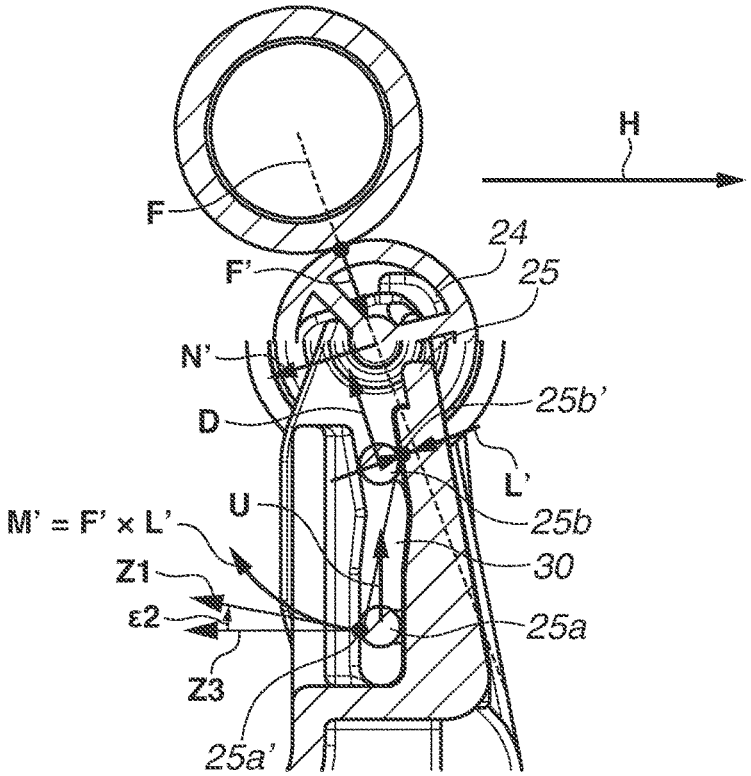
FIG. 10B illustrates a moving direction of the roller holder according to the first exemplary embodiment.

FIGS. 10A and 10B illustrate a comparative example and the present exemplary embodiment, respectively. FIG. 10A illustrates the configuration of the comparative example as a modification of the present exemplary embodiment. FIG. 10B illustrates the configuration of the present exemplary embodiment. The present exemplary embodiment is configured to provide a smaller sliding resistance when the roller holder 31 moves than the comparative example. The mechanism of the roller holder 31 will be described below.

FIG. 10A illustrates a configuration in which the moving direction D' of the first projection 25*b* and the moving direction U' of the second projection 25*a* are made parallel to the nip pressure direction F to linearly move the roller holder 31 in the nip pressure direction F. To reduce the moving region toward the downstream side of the roller holder 31 in the horizontal direction H, the positions of the first projection 25*b* and the second projection 25*a* are disposed upstream (arrow N') of the dotted line of the nip pressure direction F in the conveyance direction.

The roller holder 31 is upwardly pressed by the force of the pressing spring 26, and the first projection 25*b* comes into contact with the groove 30' at a point 25*b*'. Since the roller holder 31 receives the resistance of the nip pressure in the F' direction, a moment M'=F'*L' arises around the point 25*b*', where L' denotes the distance between the point 25*b*' and the dotted line of the nip pressure direction F. As a result, the second projection 25*a* comes into contact with the groove 30' at a point 25*a*' and receives the moment M'.

Since a direction Z1 of the force by the moment M' at the point 25*a*' and a direction Z2 perpendicular to the surface receiving the force at the point 25*a*' form an angle ε1, the upstream boss 25*a* generates a force to break into the groove 30'. Therefore, when the roller holder 31 moves downward, the sliding friction at the point 25*a*' increases, making it hard for the roller holder 31 to move downward.

On the other hand, in the configuration illustrated in FIG. 10B in which the arrow D is inclined relative to the arrow U, an angle ε2 formed by the direction Z1 and a direction Z3 perpendicular to the surface receiving the force at the point 25*a*' becomes smaller than the angle ε1. As a result, the sliding friction at the point 25*a*' relatively decreases and the roller holder 31 becomes likely to move downward.

Figure 11:
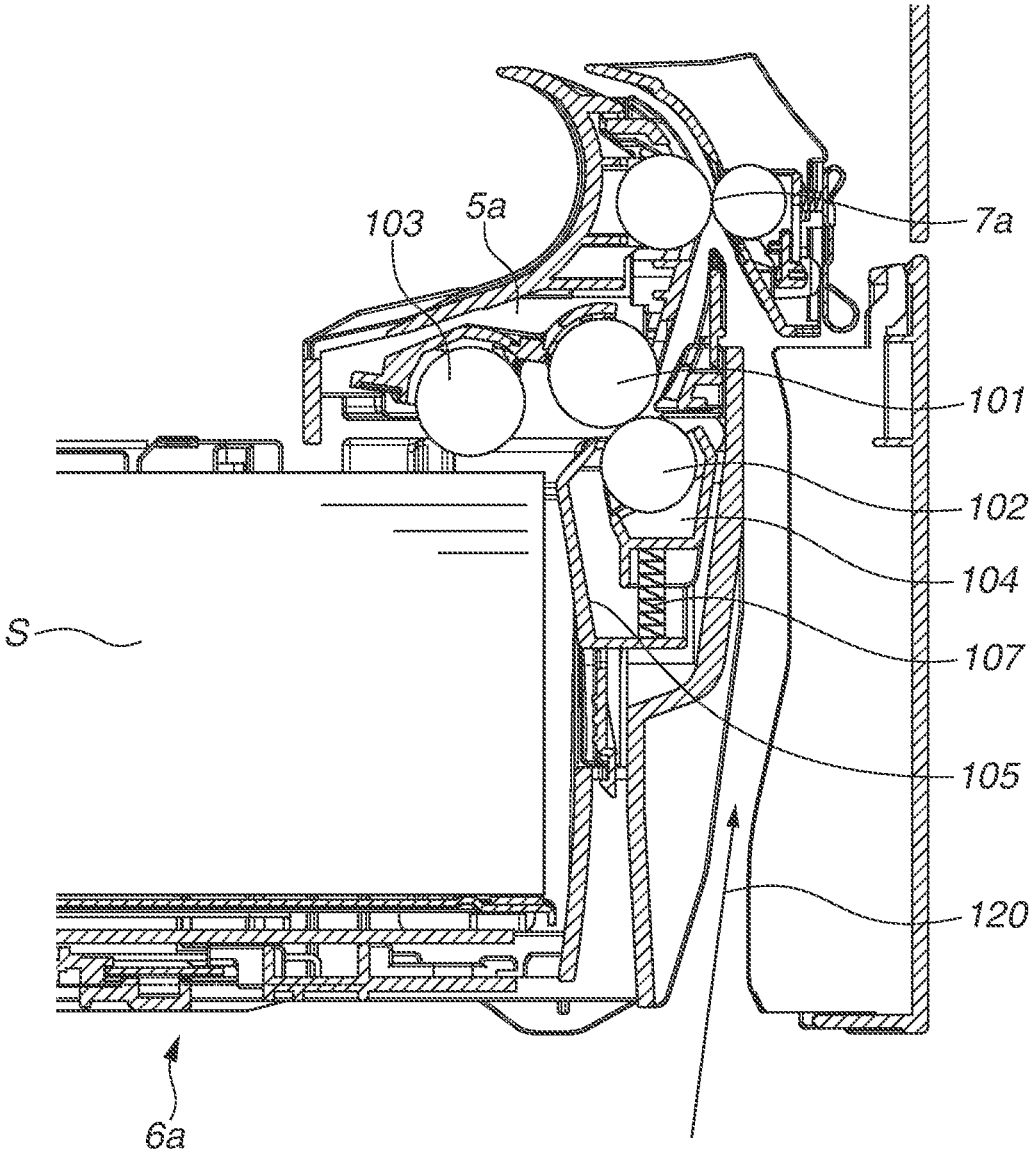
FIG. 11 is a cross-sectional view illustrating a periphery of a sheet feeding unit according to a second exemplary embodiment.

According to a second exemplary embodiment, the configuration characterizing the present disclosure is applied to the sheet feeding unit 5*a*. The present exemplary embodiment will be described below with reference to FIGS. 11 and 16A and 16B. FIG. 11 is a cross-sectional view illustrating a periphery of the sheet feeding unit 5*a*. A pick roller 103 comes into contact with the top sheet S and rotates to feed the sheet S to the nip portion formed by a feed roller 101 and a separation roller 102. The separation roller 102 incorporates a torque limiter (not illustrated). The feed roller 101 and the separation roller 102 separate and feed the sheets S one by one.

Figure 12:
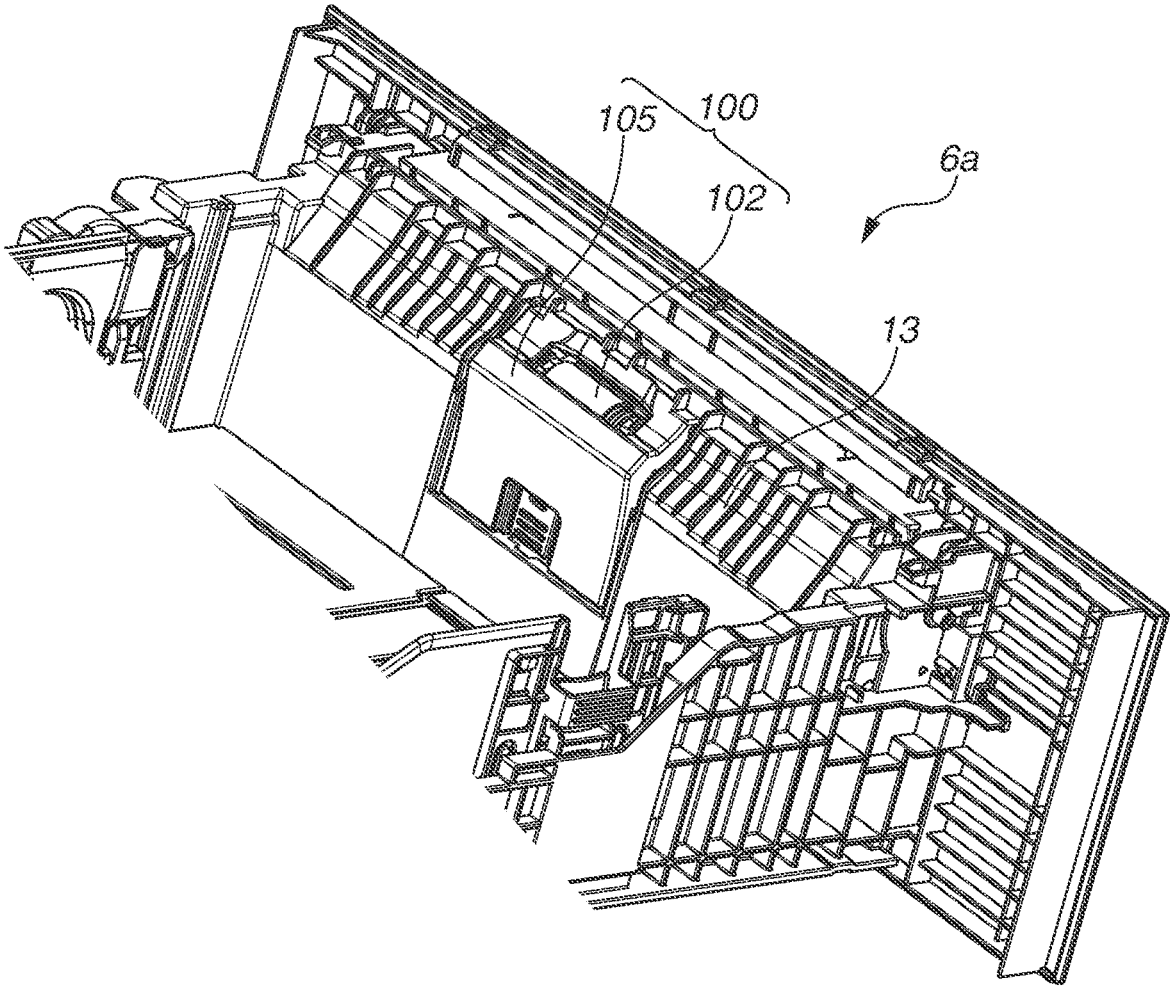
FIG. 12 is a perspective view illustrating a sheet feeding cassette according to the second exemplary embodiment.
Figure 13A:
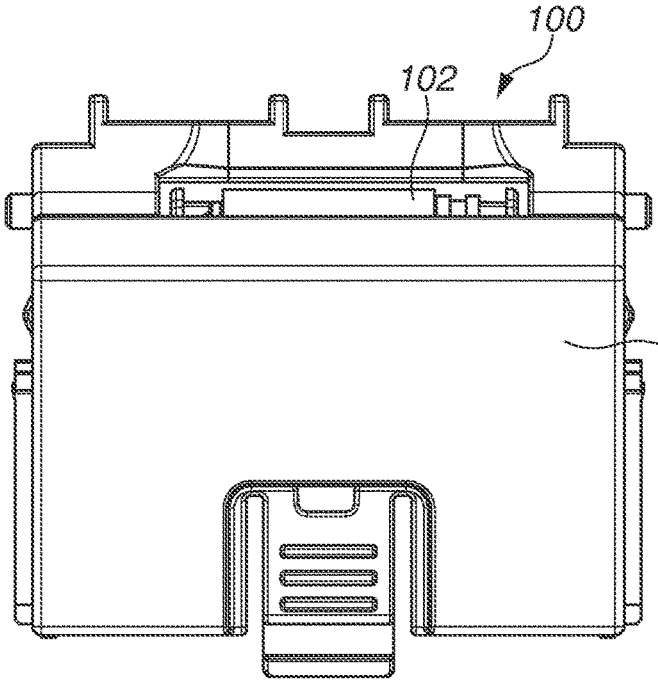
FIGS. 13A to 13D illustrate a separation roller unit according to the second exemplary embodiment.
Figure 13B:
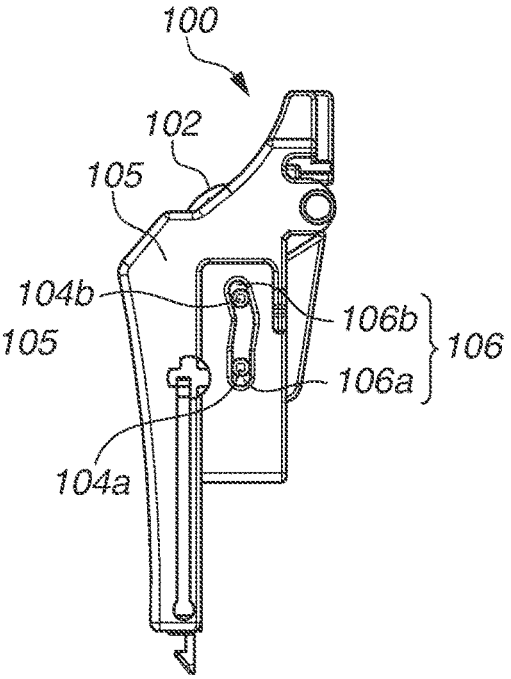
Figure 13C:
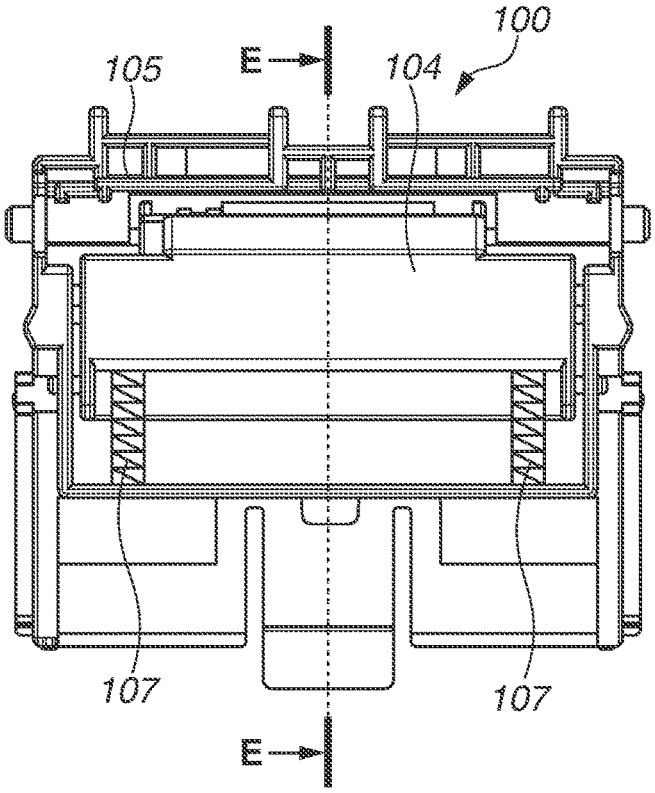
Figure 13D:
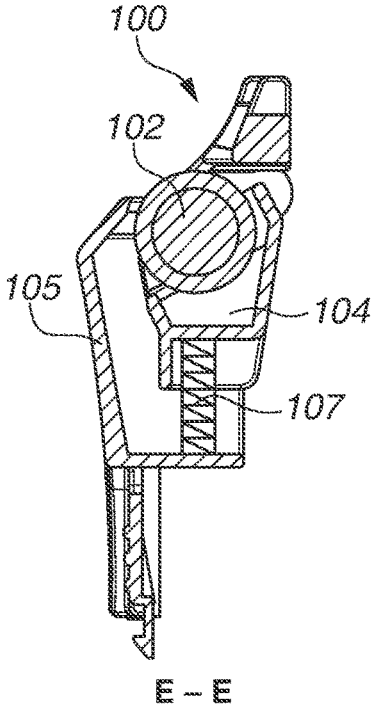

Referring to FIG. 11, a conveyance path 120 for conveying the sheet S fed from the sheet feeding unit 6*b* in FIG. 1 is provided to the right of the sheet feeding unit 5*a*. FIG. 12 is a perspective view illustrating the sheet feeding cassette 6*a*. FIGS. 13A to 13D illustrate the separation roller unit 100. FIG. 13A is a plan view, FIG. 13B is a right-side view, FIG. 13C is a rear view, and FIG. 13D is a cross-sectional view taken along the E-E line in FIG. 13C.

The separation roller unit 100 includes a separation roller 102, a separation roller holder 104, a separation guide 105, and a pressure spring 107. The separation roller 102 is held by the separation roller holder 104 that is held by the separation guide 105. When the separation roller holder 104 is pressed toward the feed roller 101 by the pressure spring 107, the nip pressure between the feed roller 101 and the separation roller 102 is applied.

Figure 14A:
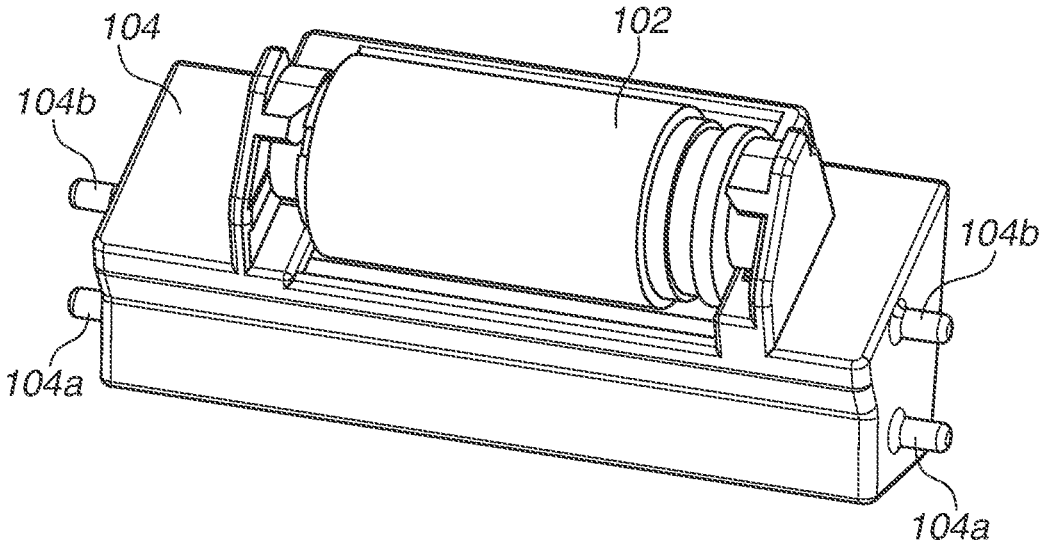
FIGS. 14A and 14B are perspective views illustrating a separation roller holder according to the second exemplary embodiment.
Figure 14B:
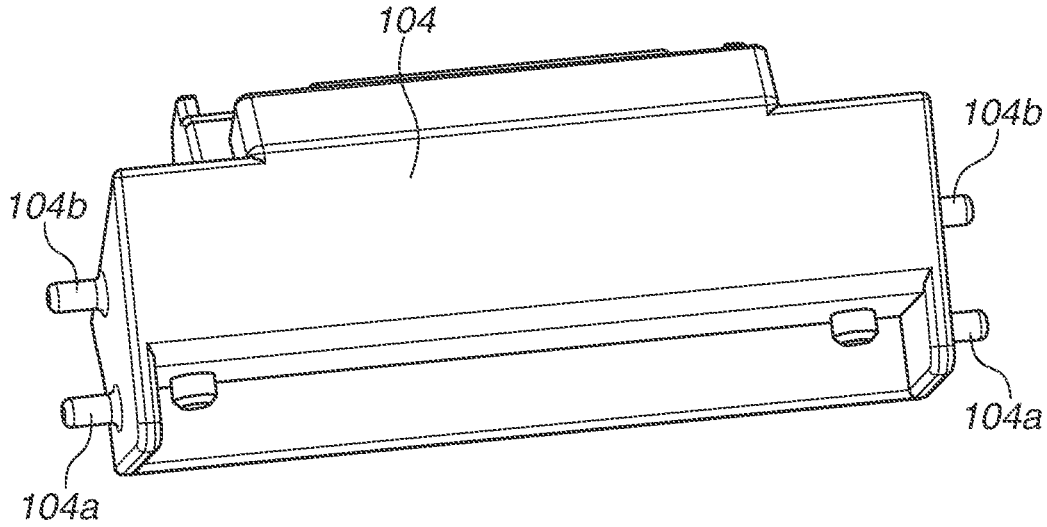
Figure 15A:
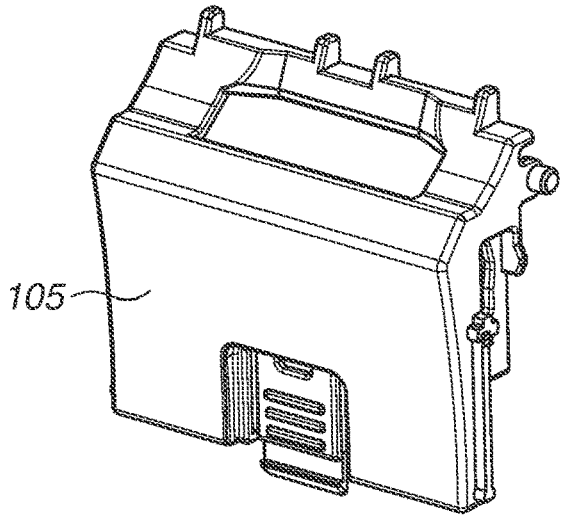
FIGS. 15A to 15C illustrate a separation guide according to the second exemplary embodiment.
Figure 15B:
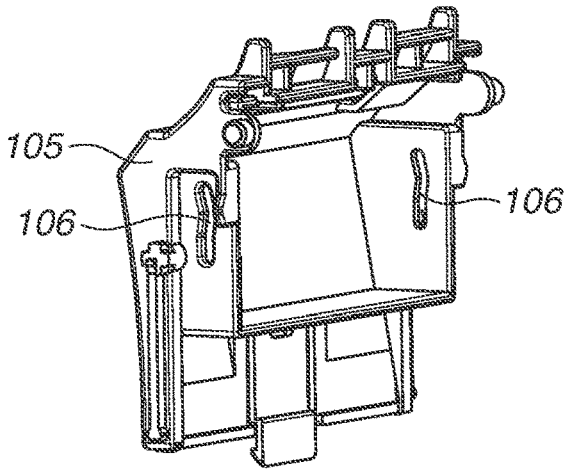
Figure 15C:
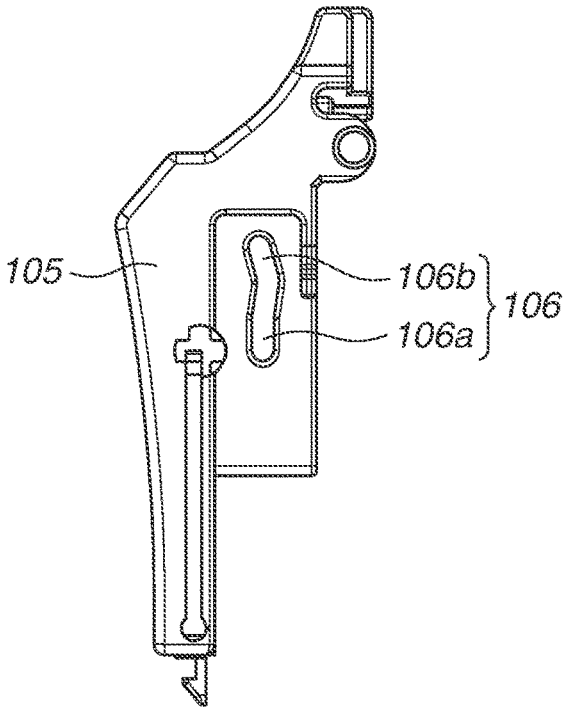

FIGS. 14A and 14B are perspective views illustrating the separation roller holder 104 holding the separation roller 102. FIGS. 15A and 15B are perspective views illustrating the separation guide 105, and FIG. 15C is a side view illustrating the separation guide 105. The separation roller holder 104 is provided with two pairs of bosses, a pair of upstream bosses 104*a* and a pair of downstream bosses 104*b* in the sheet width direction. Both side surfaces of the separation guide 105 in the sheet width direction are provided with an oblong hole 106 including an upstream oblong hole 106*a* and a downstream oblong hole 106*b*. When the upstream boss 104*a* fits into the upstream oblong hole 106*a* and the downstream boss 104*b* fits into the downstream oblong hole 106*b*, the separation roller holder 104 is held by the separation guide 105.

Figure 16A:
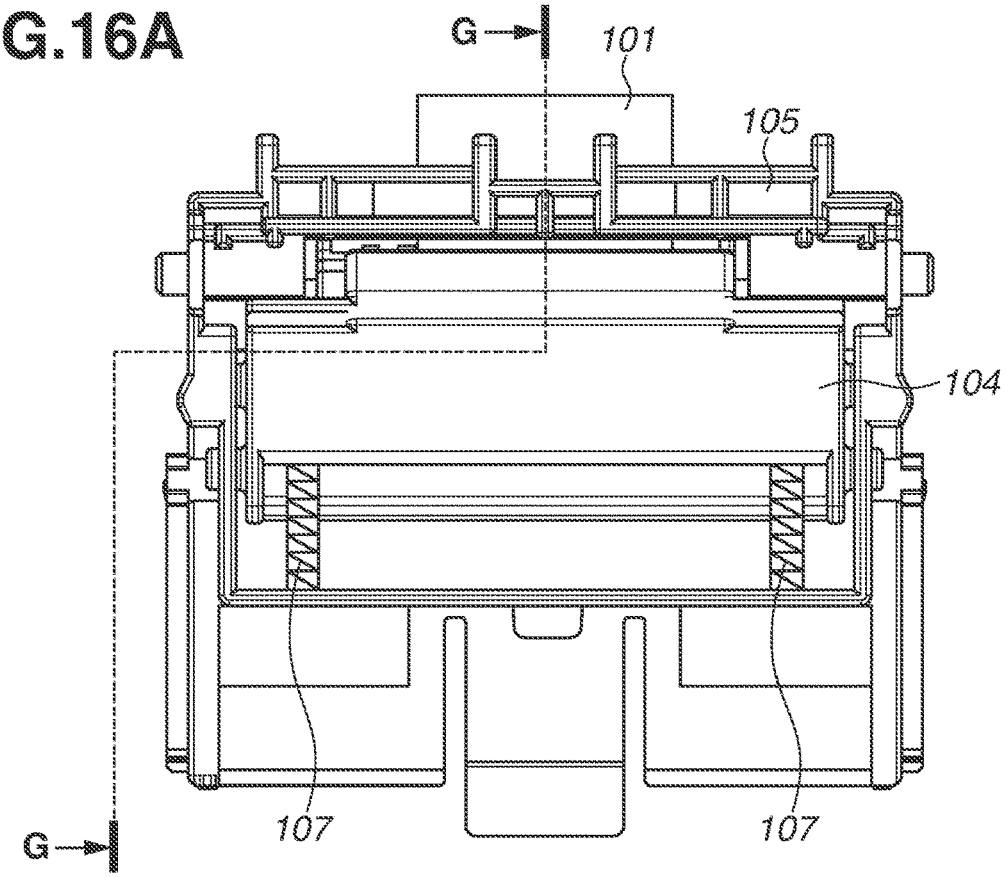
FIGS. 16A and 16B illustrate peripheries of the separation roller unit according to the second exemplary embodiment.
Figure 16B:
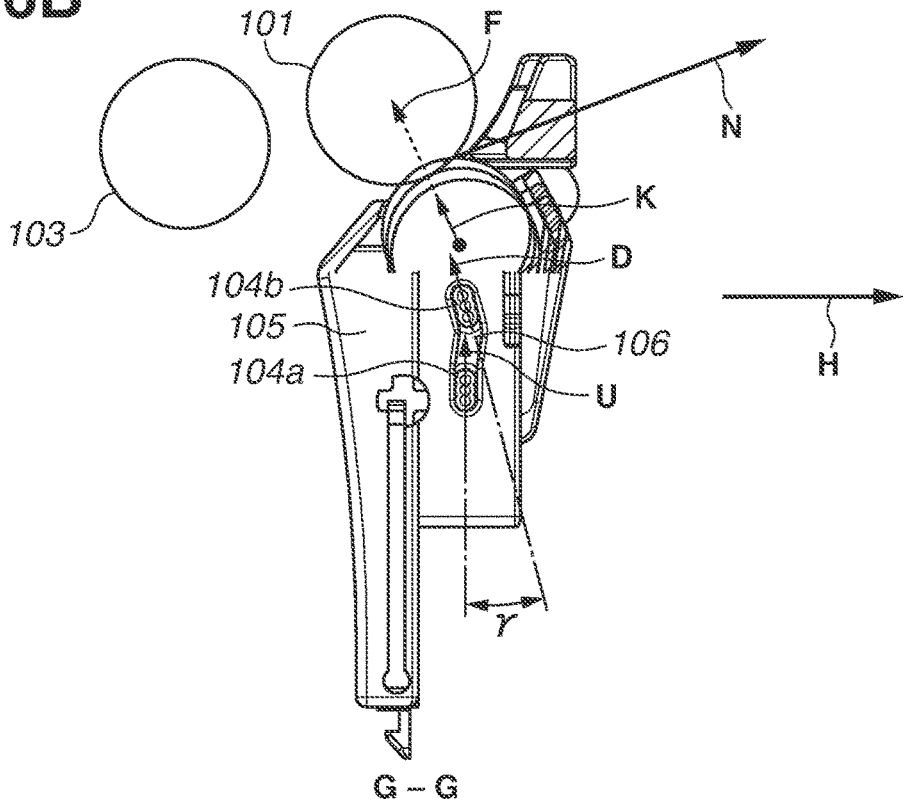

FIGS. 16A to 16B illustrate the separation roller unit 100. FIG. 16A illustrates the separation roller unit 100 when viewed in the same direction as that in FIG. 13C. FIG. 16B is a cross-sectional view taken along the G-G line in FIG. 16A, illustrating a state where the separation roller 102 and the separation roller holder 104 are in contact with the feed roller 101 and a state where the separation roller 102 is separated from the feed roller 101.

The moving direction of the downstream boss 104*b* toward the feed roller 101 is indicated by the arrow D, and the moving direction of the upstream boss 104*a* toward the feed roller 101 is indicated by the arrow U. According to the present exemplary embodiment, to achieve stable sheet feeding as in the first exemplary embodiment, the arrow D is inclined relative to the arrow U by an angle γ upstream in the conveyance direction N to bring the moving direction K of the separation roller 102 and the nip pressure direction F close to each other.

When viewed in the rotational axis direction of the separation roller 102 like the first exemplary embodiment, the angle formed by the arrow D relative to the direction of the straight line passing through the rotational centers of the separation roller 102 and the feed roller 101 is smaller than the angle formed by the arrow U relative to the direction of the straight line.

A guide path formed by the groove 106, the downstream boss 104*b*, and the upstream boss 104*a* is disposed upstream of the line of the arrow F in the sheet S conveyance direction. The use of this configuration enables reducing the downstream side of the separation roller 102 and the separation roller holder 104 in the horizontal direction H, making it possible to provide the conveyance path 120 as illustrated in FIG. 11.

The sheet conveyance apparatus of the present disclosure can effectively use the space around the rollers while restricting a large change of the sheet conveyance direction.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2022-126812, filed Aug. 9, 2022, which is hereby incorporated by reference herein in its entirety.

What is claimed is:

1. A sheet conveyance apparatus comprising:

a roller pair configured to convey a sheet and including a first roller and a second roller;

a biasing member;

a roller holder configured to hold the first roller and to be biased by the biasing member so that the first roller is biased toward the second roller, wherein the roller holder includes a guided portion and the guided portion includes a first guided portion and a second guided portion positioned upstream of the first guided portion in a biasing direction of the biasing member; and a guiding portion including a first guide and a second guide, wherein the first guide is configured to movably support and guide the first guided portion, the second guide is configured to movably support and guide the second guided portion, and the guiding portion is configured to movably guide the roller holder so that the first and second rollers can take a first state where the first roller comes into contact with the second roller with a contact force that is a predetermined force and take a second state where the contact force is reduced from the predetermined force, wherein a first direction in which the first guide guides the first guided portion is inclined relative to a second direction in which the second guide guides the second guided portion, and wherein, when viewed in a rotational axis direction of the first roller in a case where the first and second rollers are in the first state, an angle formed by a straight line passing through rotational centers of the first and second rollers and the first direction is smaller than an angle formed by the straight line and the second direction.

2. The sheet conveyance apparatus according to claim 1, wherein the first and second guided portions are projections, and the first and second guides store the first and second guided portions, respectively.

3. The sheet conveyance apparatus according to claim 2, wherein the first and second guides are grooves, and are connected.

4. The sheet conveyance apparatus according to claim 1, wherein the second roller is a drive roller for receiving a drive.

5. The sheet conveyance apparatus according to claim 4, wherein the first roller comes into contact with the second roller to be driven to rotate.

6. The sheet conveyance apparatus according to claim 1, wherein the first roller is positioned below the second roller with respect to a vertical direction.

7. The sheet conveyance apparatus according to claim 1, wherein the roller pair is configured to discharge the sheet with an image formed on the sheet.

8. The sheet conveyance apparatus according to claim 7, further comprising a sheet discharge tray configured to stack sheets discharged by the first and second rollers.

9. The sheet conveyance apparatus according to claim 1, wherein the first roller and the roller holder are detachable.

10. The sheet conveyance apparatus according to claim 1, wherein the biasing member is configured to bias the roller holder in an upward direction with respect to a vertical direction.

11. The sheet conveyance apparatus according to claim 1, wherein the first and second rollers are separated in the second state.

12. The sheet conveyance apparatus according to claim 1, wherein the rotational centers of the first and second rollers do not overlap with respect to a vertical direction.

13. The sheet conveyance apparatus according to claim 12, wherein the first and second rollers are configured to convey the sheet in an obliquely upward direction.

14. The sheet conveyance apparatus according to claim 1, wherein the first roller, the second roller, and the roller holder are disposed at a plurality of positions in the rotational axis direction of the first roller.

15. The sheet conveyance apparatus according to claim 1, wherein, when viewed in the rotational axis direction of the first roller, the first and second guides are positioned upstream of the straight line in a sheet conveyance direction of the sheet.

16. An image forming apparatus comprising:

the sheet conveyance apparatus according to claim 1; and an image forming unit configured to form an image on the sheet.

17. A sheet conveyance apparatus comprising:

a roller pair configured to convey a sheet and including a first roller and a second roller;

a biasing member;

a roller holder configured to hold the first roller and to be biased by the biasing member so that the first roller is biased toward the second roller, wherein the roller holder includes a guided portion and the guided portion includes a first guided portion and a second guided portion positioned upstream of the first guided portion in a biasing direction of the biasing member; and a guiding portion including a first guide and a second guide, wherein the first guide is configured to movably support and guide the first guided portion, the second guide is configured to movably support and guide the second guided portion, and the guiding portion is configured to movably guide the roller holder so that the first and second rollers can take a first state where the first roller comes into contact with the second roller with a contact force that is a predetermined force and take a second state where the contact force is reduced from the predetermined force, wherein a first direction in which the first guide guides the first guided portion is inclined relative to a second direction in which the second guide guides the second guided portion, and wherein, when viewed in a rotational axis direction of the first roller, the first and second guides are positioned upstream of a straight line passing through rotational centers of the first and second rollers in a sheet conveyance direction of the sheet.

18. The sheet conveyance apparatus according to claim 17, wherein the first and second rollers are configured to convey the sheet in an obliquely upward direction.

* * * * *